United States Patent [19]

Drew

[11] 4,307,925

[45] Dec. 29, 1981

[54] PLUG CONNECTOR WITH CIRCUIT BREAKER

[75] Inventor: Douglas Drew, Toronto, Canada

[73] Assignee: Noma Canada Ltd., Scarborough, Canada

[21] Appl. No.: 122,419

[22] Filed: Feb. 19, 1980

[51] Int. Cl.[3] ..... H01R 13/68

[52] U.S. Cl. ..... 339/147 P; 339/196 R

[58] Field of Search ..... 339/195 R, 195 A, 195 M, 339/196 R, 196 A, 196 M, 147 R, 147 P, 62, 63; 337/197, 198, 194

[56] References Cited

U.S. PATENT DOCUMENTS

| | | | |
|---|---|---|---|
| 2,486,380 | 11/1949 | Bauer | 337/198 |
| 2,644,057 | 6/1953 | Curtis | 337/197 |
| 2,649,522 | 8/1953 | Marcus | 337/197 |
| 4,123,737 | 10/1978 | Hoagland, Jr. | 337/68 |

FOREIGN PATENT DOCUMENTS

| | | | |
|---|---|---|---|
| 603538 | 6/1948 | United Kingdom | 339/195 A |
| 1259497 | 1/1972 | United Kingdom | 339/147 P |

*Primary Examiner*—John McQuade

*Attorney, Agent, or Firm*—Leon Arthurs; Kenneth M. Garrett

[57] ABSTRACT

A plug connector engageable with an electrical outlet comprising an insulating body encapsulating circuitry providing pathways for electrical current delivered by said connector to an associated power cord and having a deep, blind-end, socket for an elongated circuit breaker; there being a gap in said circuitry interrupting a said pathway with both terminals of the gap in position at the blind-end of said socket to be bridged by said circuit breaker.

6 Claims, 5 Drawing Figures

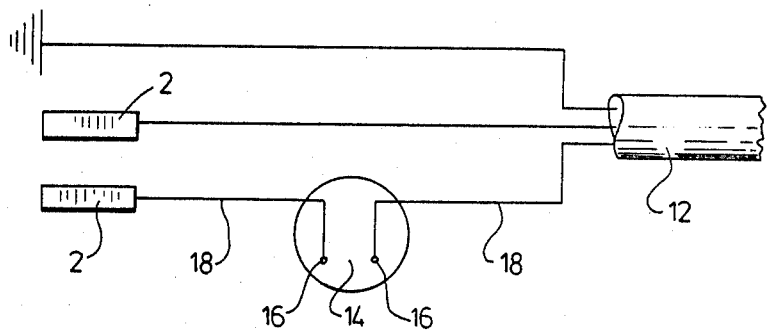
FIG. 3.
FIG. 4.
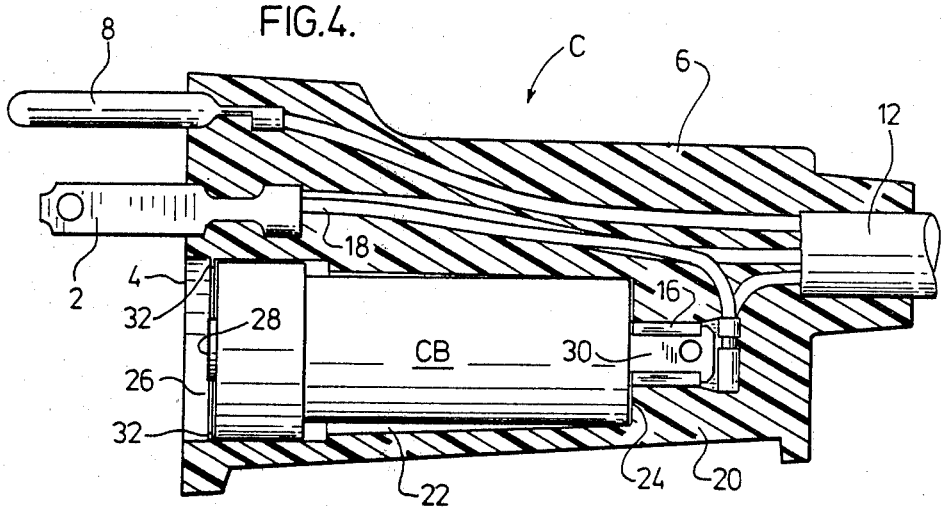
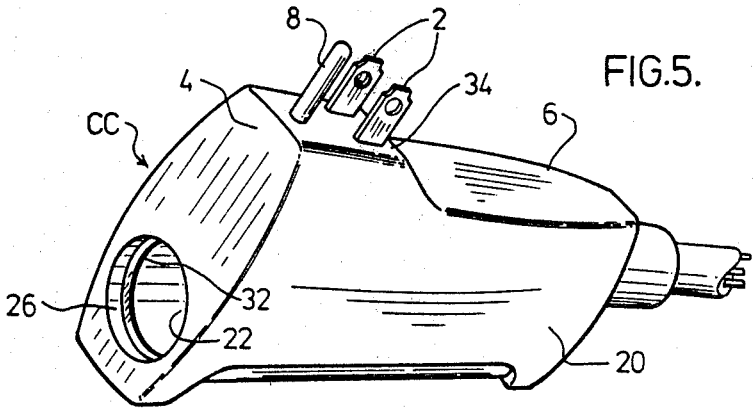
FIG. 5.

PLUG CONNECTOR WITH CIRCUIT BREAKER

FIELD OF THE INVENTION

The invention relates to a plug type connector such as is attached to one end of a power cable which is in turn attached by its other end to an electrical device hereinafter broadly referred to as a load; said connector being installable in a counterpart electrical receptacle whereby to effect temporary electrification of the load.

In particular, the connector visualized has accommodation for an associated circuit interrupter for the protection of the load against overload.

BACKGROUND OF THE INVENTION

Conventionally, circuit interrupters are expediently massed at a central location, particularly in a domestic establishment, with at least one circuit interrupter of average capacity of—say—15 amperes (in North America) governing each circuit.

Such capacity may be excessive and the protection afforded thereby may hence be inadequate, however, for a load with a critical power rating below that capacity and such load may be damaged or may create damage if its rating is exceeded for an appreciable length of time. For such loads which are not individually fused, adequate protection may be obtained by the use of a cable, equipped as contemplated by the present invention with its own individual circuit interrupter.

For the sake of clarity it should be understood that the term "circuit interrupter" is herein applied to any device which provides a conductive link in an electrical circuit designed to "open" under overload thus interrupting the circuit. While various types of circuit interrupters are available, that particularly visualized by the invention is restorable (or resettable) to "closed" position thus re-constituting the circuit when the overload has been removed or cured. This type of circuit interrupter is generally identified as a circuit breaker whereas the common non-resettable type is known as a fuse which burns out or "blows" under overload.

The use of power cables which are "fused" as distinguished from those equipped with circuit breakers is not new; there being much prior art relating thereto. These suffer, however, from one major disadvantage, amongst others, in that the lack of a replacement fuse or the proper repair materials in an emergency may prompt someone to resort to evasive means for restoring a power cable to functionality thereby depriving its associated load of essential protection—more or less permanently, since it is a common human tendency to leave an emergency repair as a permanent repair thereby totally defeating the intent and primary function of the fused power cable.

SUMMARY OF THE INVENTION

In its broadest aspect, the invention proposes to enable replacement of the known fused power cable with one which is equipped with a circuit breaker in the place of a fuse.

While circuit breakers were always intended to take the place and serve the purpose of fuses, their prior use in power cables as herein visualized is believed to be entirely novel having regard to relevant circumstances becoming hereinafter more apparent, the concept is believed entitled to be dignified as an invention.

At all events, the invention goes much further than the mere substitution of a circuit breaker for the fuse of a fused power cable; providing, as well, a connector plug which is adapted to accommodate a relatively intricate circuit breaker.

Essentially, the invention does this by elongating the conventional connector and adding a lobe at one side thereof which provides accommodation for an axial or cartridge type of circuit breaker so as to make it very difficult to override the circuit breaker whether accidentally or intentionally; this being a primary object of the invention.

OBJECTS OF THE INVENTION

Other objects of the invention include the provision of a connector with a body providing accommodation for an axial type of circuit breaker in the form of a deep and narrow socket with a blind end at which are located the terminals requiring to be bridged by the circuit breaker. For retaining the circuit breaker in the socket after its installation therein, the socket is preferably formed of a material resistant to deformation which will stretch sufficiently during the manufacturing phase to receive the circuit breaker and will thereafter contract to retain it tightly; this being a further and more particular object of the invention.

BRIEF DESCRIPTION OF THE DRAWINGS

The foregoing and other more or less broad aims and objects of the invention will become apparent from the hereinafter following description of the elements, parts and principles of the invention as applied to one selected embodiment thereof which is described by way of example only in the hereunto annexed drawing wherein:

FIG. 3 is a wiring diagram of the circuitry of FIG. 2.

FIG. 4 is a section through the connector of FIG. 1 with a circuit-breaker added thereto, and FIG. 5 is an isometric view of a right angle connector.

DESCRIPTION OF A SELECTED AND PREFERRED EMBODIMENT

Figure 1:
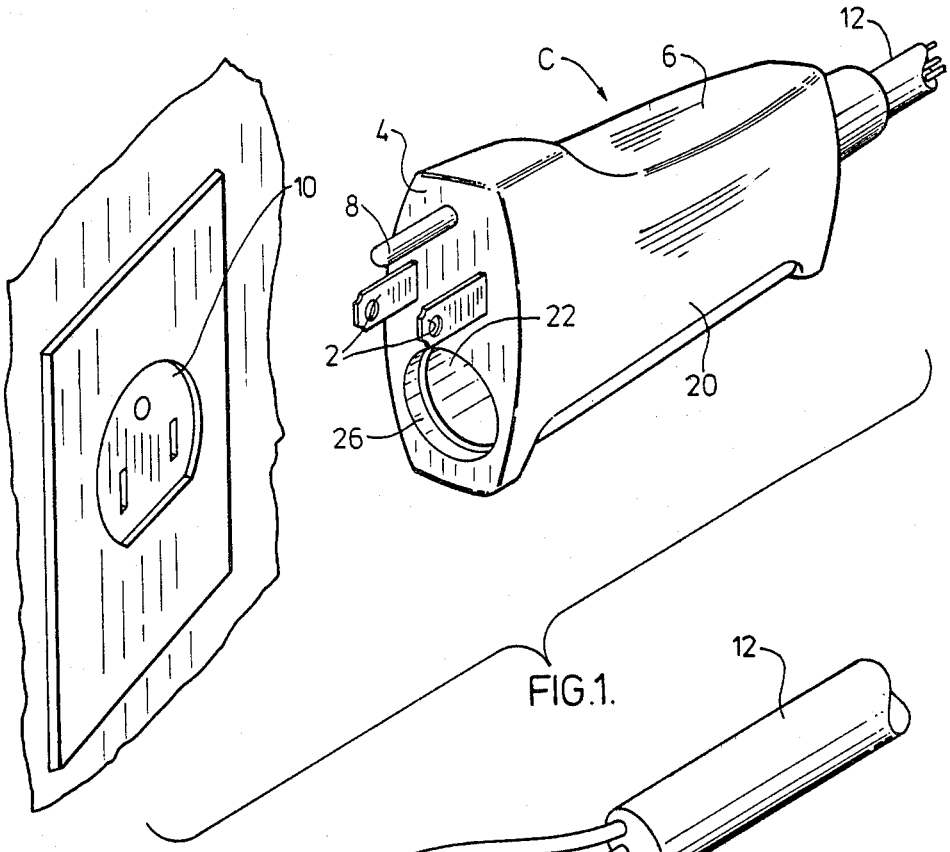
FIG. 1 is an isometric view of a straight line connector according to the invention with a fragment of a power cable protruding therefrom and in conjunction with an outlet in which the connector is installable.

As will be apparent from FIG. 1 of the drawing, the present connector C is illustrated in the male format with blades 2—2 projecting from a face 4 at one end of connector body 6 in common with the sometimes optional ground pin 8; and body 6 being elongated and relatively slim to permit it to be grasped manually for installation of connector C in an electrical outlet 10 in interconnection with terminals contained therein which correspond to and usually mate with the connector terminals constituted by blades 2—2.

Figure 2:
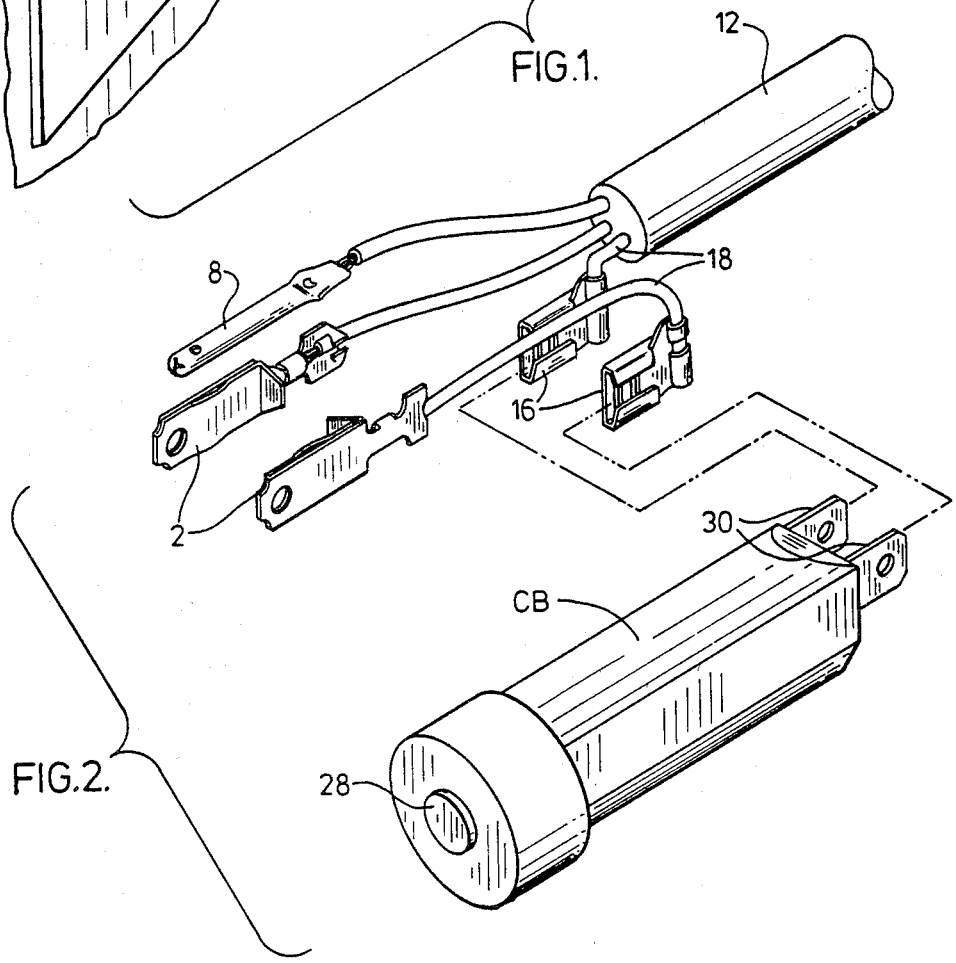
FIG. 2 is a skeletal view of the interior circuitry of FIG. 1 shown in conjunction with a circuit-breaker co-operable therewith.

In the skeletal view of FIG. 2, each blade 2 is seen to constitute a terminal of circuitry encapsulated in body 6 which connects, ultimately, to power cable 12 leading to an electrical load (not shown); said circuitry thus providing pathways for the flow of electrical current between the load and electrical outlet 10.

The wiring diagram of FIG. 3 shows a gap 14 between gap terminals 16—16 in one of the pathways 18 of the circuitry aforesaid.

Said body 6 includes a lobe 20 which is integral therewith and which, in the form of FIG. 1, extends the full length of connector C. Said lobe 20 contains an axial socket 22 with a blind end 24 at its bottom; the opposite or top end of socket 22 being located at opening 26 in body face 4. Said socket 22 is intended to provide accommodation for a slim, elongated, axial or cartridge type of circuit breaker CB, such as is described for example in U.S. Pat. No. 4,123,737 issued on Oct. 31, 1978 to Heinemann Electric Co., having a re-set button 28 at its top end and prongs 30—30 at its face which are, of course, the external terminals of its internal mechanism and are engageable in gap terminals 16—16 at the blind end 24 of socket 22.

The selection of this elongated axial type of circuit breaker for the present invention permits the body 6 as a whole—including lobe 20—to be proportioned for manual grasping and further enables the socket 22 to be made deep and narrow whereby to frustrate and severely restrict the possibility of overriding circuit breaker CB.

Moreover, body 6 as well as lobe 20 are formed of moldable insulating material which, in its hardened form, may have a durometer rating of—say—80 or so with a narrow ledge 32 just inside socket opening 26; this ledge 32 serving as a retaining ring to prevent withdrawal of circuit breaker CB from socket 22 into which it is installed preferably immediately after molding of body 6 and while it is still somewhat plastic.

The depth of socket 22 contained in lobe 20 is commensurate with the length of circuit breaker CB so that when its prongs 30—30 are plugged into gap terminals 16—16 at its blind end 24, its top end and re-set button 28 will be set marginally within the face 4 of body 6 and hence be occluded when connector C is installed in electrical outlet 10 in the usual well understood manner. It will be appreciated that the relative inaccessibility of gap terminals 16—16 at the blind end 24 of socket 22 is a major impediment to any attempted overriding of circuit breaker CB.

As will be further apparent from FIG. 2, gap terminals 16—16 are molded into lobe 20 at the blind end 24 of socket 22 in a position to receive and be bridged by circuit breaker CB when the latter is installed therein.

Thus, when circuit breaker CB is in place as in FIG. 4 and in its closed attitude, it will close gap 14 thus establishing electrical pathway 18. Conversely, when tripped by an overload, circuit breaker CB will assume an open attitude, thereby re-opening gap 14 and opening electrical pathway 18. Subsequently, circuit breaker CB may, of course, be restored to its closed attitude through the intermedium of re-set button 28 to reestablish electrical pathway 18.

In the right angled form of FIG. 5, the present connector C is intended for use in situations where the length of body 6 may prove awkward.

In essence, therefore, the major distinction between the straight line connector C of FIG. 1 and right angled connector CC of FIG. 5 is that the terminals 2—2 and ground pin 8 of the latter emerge from body 6 through its top wall 34 instead of through its face 4.

As will be evident from the foregoing the present connector C will normally be found at the end of a power cable through which electrical energy is delivered to a load from an electrical outlet.

Said connector is equipped with a circuit breaker with a rating which is commensurate with the rating of the load so as to break the circuit between the electrical outlet and the load when the rating is exceeded by the actual current flow.

I claim:

1. A plug connector temporarily engageable with an electrical outlet for electrification of a load attached to the connector, comprising:

connector terminals respectively interconnectible with corresponding terminals at said electrical outlet;

an axially elongated insulating body encapsulating circuitry in said connector providing pathways for electrical current flowing between said outlet and said load;

a gap in said circuitry interrupting a said pathway;

said body having a generally axially aligned, deep and narrow blind socket opening therein having an opening on the exterior of the insulating body for a circuit breaker bridging said gap and having closed and open attitudes for respectively closing and opening said gap, and said gap having terminals located at the blind end of said socket opening for connecting to said circuit breaker, thereby restricting access to said gap.

2. A plug connector as claimed in claim 1, wherein said body has a face which abuts the electrical outlet when the connector is engaged therewith; the opening of said socket being in said face and being occluded when the face aforesaid abuts the electrical outlet.

3. A plug connector as claimed in claim 1 or 2 wherein said body includes an integral lobe at a side thereof, the socket being contained in said lobe.

4. A plug connector as claimed in claim 1 or 2, wherein said body includes an integral lobe at a side thereof, the socket being contained in said lobe and also has a face which abuts the electrical outlet when the connector is engaged therewith; the opening of said socket being in said face and being occluded when the face aforesaid abuts the electrical outlet.

5. A plug connector as claimed in claim 2 wherein said body includes an integral lobe at a side thereof, the socket being contained in said lobe; a circuit breaker installed in said socket having terminals axially engageable with the gap terminals at the blind end of said socket.

6. A plug connector as claimed in claim 2 or 5, including a resettable circuit breaker installed in said socket; said circuit breaker having terminals axially engageable with the gap terminals at the blind end of said socket.

7. A plug connector as claimed in claim 1 wherein said body is molded in insulating material and wherein the walls forming said blind socket include a narrow ledge adjacent the socket opening to serve as a retaining means for said circuit breaker.

* * * * *